US009984569B1

(12) United States Patent
Howell et al.

(10) Patent No.: US 9,984,569 B1
(45) Date of Patent: May 29, 2018

(54) HAUL ROAD ACCIDENT PREVENTION DEVICE

(71) Applicants: Shane D. Howell, Dallas, TX (US); Mike S. Merrell, Royce City, TX (US); Justin L. Kropp, Dallas, TX (US)

(72) Inventors: Shane D. Howell, Dallas, TX (US); Mike S. Merrell, Royce City, TX (US); Justin L. Kropp, Dallas, TX (US)

( * ) Notice: Subject to any disclaimer, the term of this patent is extended or adjusted under 35 U.S.C. 154(b) by 0 days. days.

(21) Appl. No.: 15/219,603

(22) Filed: Jul. 26, 2016

Related U.S. Application Data

(60) Provisional application No. 62/197,970, filed on Jul. 28, 2015.

(51) Int. Cl.
*G08G 1/07* (2006.01)
*G08G 1/16* (2006.01)

(52) U.S. Cl.
CPC ..... *G08G 1/07* (2013.01); *G08G 1/166* (2013.01)

(58) Field of Classification Search
CPC . G08G 1/07; G08G 1/01; G08G 1/166; G08B 5/006
USPC ..... 340/917, 908, 908.1, 905
See application file for complete search history.

(56) References Cited

U.S. PATENT DOCUMENTS 5,900,826 A * 5/1999 Farber ..... G08G 1/0955 116/63 P
6,243,644 B1 * 6/2001 Dengler ..... G08G 1/01 340/907
6,559,774 B2 * 5/2003 Bergan ..... G08G 1/095 340/907
7,148,813 B2 * 12/2006 Bauer ..... G08G 1/095 340/905
7,696,903 B2 * 4/2010 Stam ..... B60Q 9/00 340/905
8,004,425 B2 * 8/2011 Hoek ..... G01P 1/08 340/435

* cited by examiner

*Primary Examiner* — Phung Nguyen
(74) *Attorney, Agent, or Firm* — Clifford H. Kraft

(57) ABSTRACT

A haul road safety system that includes a flashing stop sign is positioned at the intersection in a standard position. A doppler radar is set up and mounted on a wig wag warning sign typically; however, it can be placed on another platform in any convenient location. When the radar detects a moving vehicle, it causes the sign's electronics to activate and the sign to illuminate and its warning lights to blink. The sign is programmed to warn of the existence of the intersection and the necessity to stop ahead. At the same time, a radio signal is sent from the radar/electronics module to the flashing stop sign at the intersection which immediately begins flashing.

12 Claims, 6 Drawing Sheets

Components

- -Standard Advanced Warning sign mounted on a trailer with a LED wig wag lite system with solar capabilities.
- -LED Regulatory STOP sign with Solar capabilities.
- Radar microwave traffic sensor
- Radio frequency communication

Fig. 5

HAUL ROAD ACCIDENT PREVENTION DEVICE

BACKGROUND

Field of the Invention

The present invention relates generally to traffic safety devices and more particularly to a haul road accident prevention device.

Description of the Problem Solved

In many areas, haul roads or other side roads intersect highways. The haul road may come in at an angle to the highway or intersect it at right angles. There is usually some sort of stop sign at the termination of the haul road. However, many accidents are reported as heavy trucks do not see the stop sign in time to stop (or there is no stop sign). When the fast moving truck enters the highway, a very serious accident situation exists since oncoming drivers on the highway have no warning whatsoever that a truck is about to enter the highway at high speed.

It would be advantageous to have a system that could warn the haul road truck driver in time that he is approaching a highway, especially when the haul road enters the highway at an angle.

SUMMARY OF THE INVENTION

The present invention includes a warning sign that is positioned down the haul road from the intersection at a distance sufficient for a fast moving loaded truck to stop. A flashing stop sign is positioned at the intersection in a standard position. A doppler radar is set up and mounted on a wig wag warning sign typically; however, it can be placed on another platform in any convenient location. When the radar detects a moving vehicle, it causes the sign's electronics to activate and the sign to illuminate and its warning lights to blink. The sign is programmed to warn of the existence of the intersection and the necessity to stop ahead. At the same time, a radio signal is sent from the radar/electronics module to the flashing stop sign at the intersection which immediately begins flashing.

DESCRIPTION OF THE FIGURES

Attention is now directed to several drawings the illustrate features of the present invention.

FIG. 5 shows a summary of features of the present invention.

Several figures and illustrations have been provided to aid in understanding the present invention. The scope of the present invention is not limited to what is shown in the figures.

DESCRIPTION OF THE INVENTION

Figure 1:
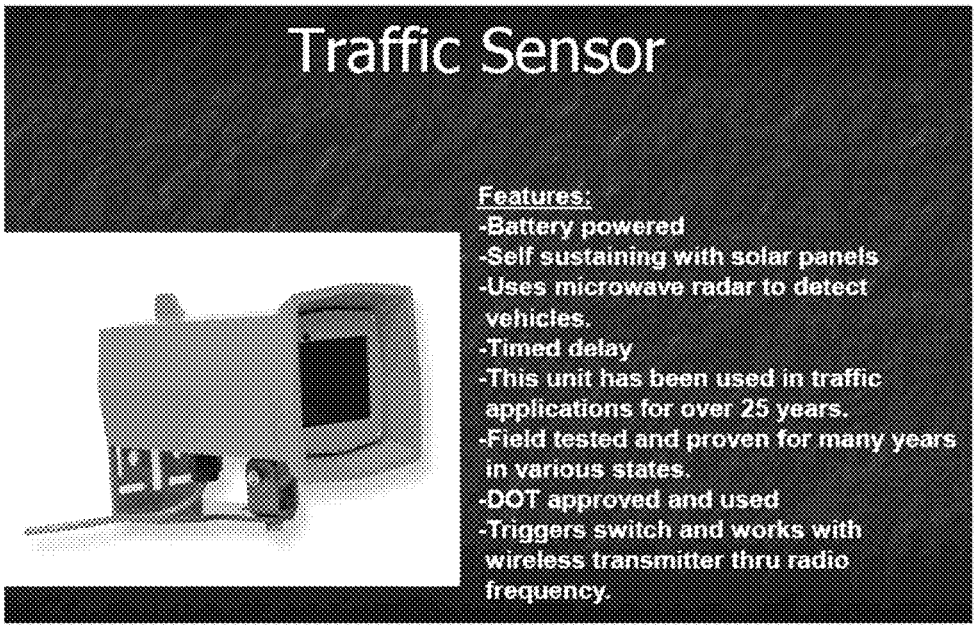
FIG. 1 shows a Doppler radar module.

The present invention is a haul road—highway interface safety system that warns the haul road driver of the intersection in time to slow down and/or stop. A doppler radar sensor communicates wirelessly with a wig-wag type safety sign and a flashing stop sign. The doppler radar is used as a sensor to sense an approaching vehicle on the haul road. An example of a doppler radar is shown in FIG. 1

Figure 2:
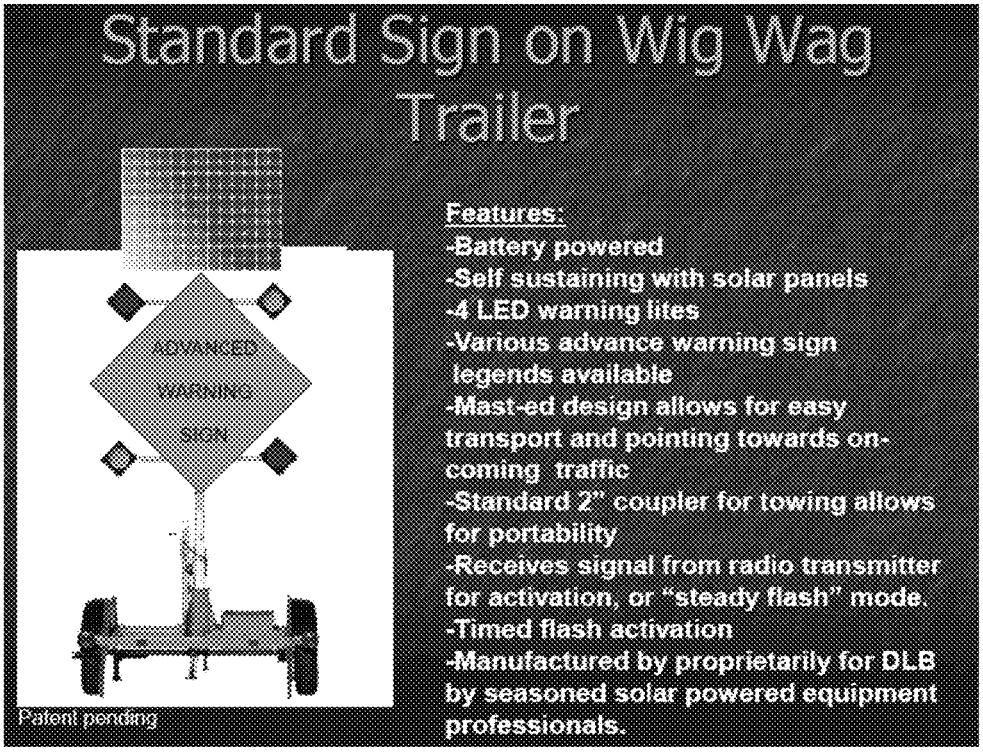
FIG. 2 shows a Wig-Wag Safety Sign.

A wig-wag safety sign is a sign that states the situation to the drive and is equipped with flashing lights. The wig-wag sign is typically powered by a solar panel and batteries. A typical wig-way safety sign is shown in FIG. 2

Figure 3:
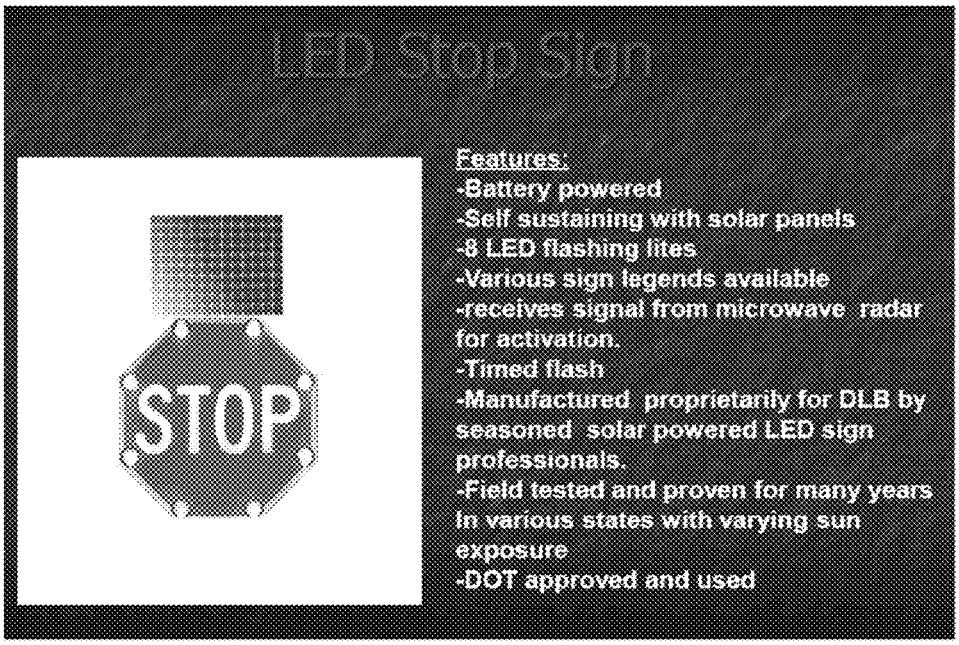
FIG. 3 shows a Flashing Stop Sign.

A flashing stop sign is a standard red stop sign whose perimeter is surrounded by a ring of flashing lights, typically LEDs, usually white or red. The word STOP can also be made to flash or can be lighted steady. The flashing sign may have an automatically adjusting intensity that decreases at night to avoid blinding drivers. The flashing stop sign can also be powered by a solar panel and batteries. The flash rate is a DOT mandated rate of between 55-70 flashes per minute. A typical flashing stop sign is shown in FIG. 3

Figure 4:
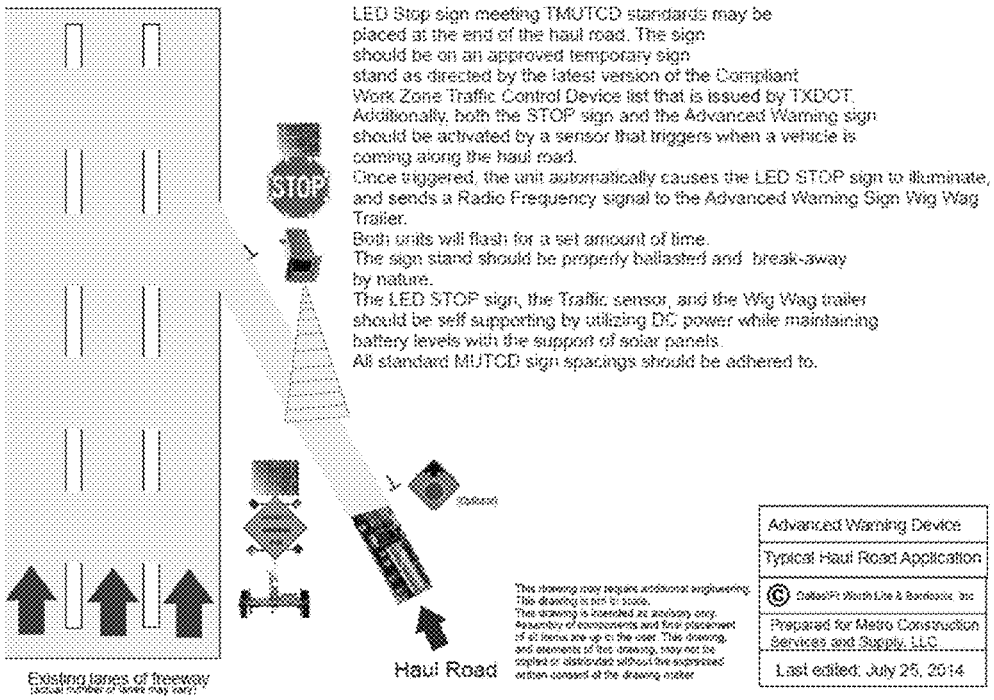
FIG. 4 shows an embodiment of the present invention.

The present invention connects the doppler radar to the wig-wag sign and the flashing stop sign using wireless communication. In particular, any wireless radio techniques may be used. The system may communicate on unlicensed or licensed channels. Typical wireless techniques include, but are not limited to, Zigbee, WiFi, cellular telephone, point-to-point wireless communication and the like. Any wireless technique is within the scope of the present invention. FIG. 4 shows an embodiment of the system.

When the system is set up, the warning sign is positioned down the haul road from the intersection at a distance sufficient for a fast moving loaded truck to stop. The flashing stop sign is positioned at the intersection in a standard position. The Doppler radar is mounted on the wig wag warning sign typically; however, it can be placed on another platform in any convenient location. When the radar detects a moving vehicle, it causes the sign's electronics to activate and the sign to illuminate and its warning lights to blink. The sign is programmed to warn of the existence of the intersection and the necessity to stop ahead. At the same time, a radio signal is sent from the radar/electronics module to the flashing stop sign which immediately begins flashing.

The implementation of the above-described system results in the saving of life an property by preventing, or at least reducing, haul road—highway accidents by simply giving the haul road drive adequate warning of the impending danger.

FIG. 5 lists a summary of features of the present invention.

Figure 6:
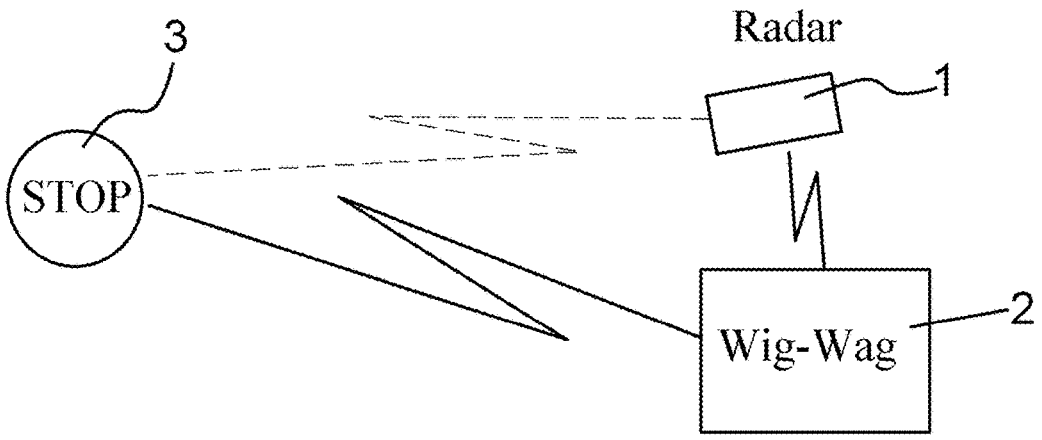
FIG. 6 shows a block diagram of communication paths for an embodiment of the present invention.

FIG. 6 shows a block diagram of the communication paths of an embodiment of the present invention. The doppler radar 1 detects motion and can communicate wirelessly with the wig-wag sign 2. The wig-wag sign 2 can communication wirelessly with the blinking stop sign 3. In an alternate embodiment, the doppler radar 1 can communicate directly with the lighted stop sign 3. In some embodiments, cables may be run between some of the units. In a particular embodiment, the doppler radar 1 is mounted on the wig-wag sign 2.

Several descriptions and illustrations have been presented that aid in understanding the present invention. One with skill in the art will realize that numerous changes and variations may be made without departing from the spirit of the invention. Each of these changes and variations is within the scope of the present invention. The scope of the invention is not limited by what is shown in any of the illustrations.

We claim:

1. A system for preventing haul road accidents comprising:

a doppler radar module directed down a haul road in proximity to an intersection of the haul road and a highway to detect oncoming moving vehicle presence on the haul road, the doppler radar unit also containing a radio transmitter that is constructed to transmit a radio signal upon detecting an oncoming moving vehicle on the haul road;

a lighted safety warning sign on a wig-wag trailer having a first radio receiver mounted on the wig-wag trailer, the safety warning sign constructed to light and flash a warning when the doppler radar module detects and oncoming vehicle on the haul road and transmits the radio signal from its radio transmitter, the radio signal being received by the first radio receiver;

a flashing stop sign located at the intersection of the haul road and the highway directed down the haul road, the flashing stop sign containing a second radio receiver and constructed to blink upon receipt of the radio signal transmitted from the transmitter on the doppler radar module;

wherein the lighted safety warning sign blinks for a predetermined time duration upon receiving the radio signal transmitted by the transmitter and then stops blinking.

2. The system of claim 1 wherein the doppler radar module is mounted on the lighted safety warning sign.

3. The system of claim 1 wherein the lighted safety warning sign is orange and diamond-shaped.

4. The system of claim 3 wherein the lighted safety warning sign is battery-powered with solar panel battery recharging.

5. The system of claim 1 wherein the lighted safety warning sign is battery-powered with solar panel battery recharging.

6. The system of claim 1 wherein the flashing stop sign contains 8 LEDs.

7. The system of claim 6 wherein the flashing stop sign is battery powered with solar cell recharging.

8. The system of claim 1 wherein the flashing stop sign is battery powered with solar cell recharging.

9. A haul-road safety system comprising:

a doppler radar unit, the doppler radar unit containing a radio transmitter, the doppler radar unit pointed along a haul road and constructed to transmit a radio signal upon detection of an approaching vehicle on the haul road;

a battery-powered flashing warning sign constructed to receive the radio signal from the radio transmitter to start blinking for a predetermined duration and then to stops blinking; wherein, the battery-powered warning sign is recharged by a solar panel;

a battery-powered flashing stop sign constructed to receive the radio signal from the radio transmitter to start blinking for a predetermined duration and then to stops blinking; wherein, the battery-powered warning sign is recharged by a solar panel.

10. The system of claim 9 wherein the flashing stop sign contains 8 LEDs.

11. The system of claim 9 wherein the flashing safety warning sign is orange and diamond-shaped.

12. A haul-road safety system comprising:

a doppler radar unit, the doppler radar unit containing a radio transmitter, the doppler radar unit pointed along a haul road and constructed to transmit a radio signal upon detection of an approaching vehicle on the haul road;

a battery-powered flashing warning sign constructed to receive the radio signal from the radio transmitter to start blinking for a predetermined duration and then to stops blinking; wherein, the battery-powered warning sign is recharged by a solar panel;

a battery-powered flashing stop sign constructed to receive the radio signal from the radio transmitter to start blinking for a predetermined duration and then to stops blinking; wherein, the battery-powered warning sign is recharged by a solar panel;

wherein the flashing stop sign contains 8 LEDs, and wherein the flashing safety warning sign is orange and diamond-shaped.

* * * * *